US009587821B2

(12) United States Patent
Carroll

(10) Patent No.: US 9,587,821 B2
(45) Date of Patent: Mar. 7, 2017

(54) LIGHTING HARNESS FOR ILLUMINATING ANIMAL SKULL

(71) Applicant: OLD GOAT OUTDOORS LLC, Hamburg, NY (US)

(72) Inventor: Michael E. Carroll, Hamburg, NY (US)

(73) Assignee: Old Goat Outdoors LLC, Hamburg, NY (US)

( * ) Notice: Subject to any disclaimer, the term of this patent is extended or adjusted under 35 U.S.C. 154(b) by 308 days.

(21) Appl. No.: 14/314,793

(22) Filed: Jun. 25, 2014

(65) Prior Publication Data

US 2014/0307424 A1 Oct. 16, 2014

Related U.S. Application Data

(63) Continuation-in-part of application No. 13/773,698, filed on Feb. 22, 2013, now abandoned.

(60) Provisional application No. 61/601,914, filed on Feb. 22, 2012, provisional application No. 61/696,371, filed on Sep. 4, 2012.

(51) Int. Cl.

| | |
|---|---|
| ***H01B 7/00*** | (2006.01) |
| ***F21S 4/00*** | (2016.01) |
| ***F21V 33/00*** | (2006.01) |
| ***B44C 5/02*** | (2006.01) |
| ***H05B 33/08*** | (2006.01) |
| ***H05B 37/02*** | (2006.01) |
| *F21V 23/04* | (2006.01) |
| *F21W 121/00* | (2006.01) |
| *F21Y 101/00* | (2016.01) |

(52) U.S. Cl.

CPC ..... *F21V 33/0028* (2013.01); *B44C 5/02* (2013.01); *F21S 4/10* (2016.01); *H05B 33/0857* (2013.01); *H05B 37/0272* (2013.01); *F21V 23/04* (2013.01); *F21W 2121/00* (2013.01); *F21Y 2101/00* (2013.01); *F21Y 2113/13* (2016.08); *F21Y 2115/10* (2016.08)

(58) Field of Classification Search

CPC ..... H01B 7/0045; H01B 5/08; Y10S 362/806

See application file for complete search history.

(56) References Cited

U.S. PATENT DOCUMENTS 1,656,148 A * 1/1928 Harris ..... A47G 33/06 362/123
2,880,408 A * 3/1959 Sewell ..... B60Q 1/44 116/37
3,214,579 A * 10/1965 Pacini ..... H01R 25/006 362/123
3,789,211 A * 1/1974 Kramer ..... F21S 10/04 315/185 S (Continued)

OTHER PUBLICATIONS http://www.hauntersdepot.com/2007NEWTEMPLATES/GoryPropsAndCostumes.htm, Oversize Lurkers, Puppets, and Other Costumes, Aug. 13, 2014.

*Primary Examiner* — Ismael Negron

(74) *Attorney, Agent, or Firm* — Simpson & Simpson, PLLC

(57) ABSTRACT

An animal skull having a nasal cavity, a brain cavity, and a pair of eye sockets, and a lighting harness including at least four lighting elements, wherein at least one lighting element is operatively arranged within each one of the nasal and brain cavities, and the eye sockets.

30 Claims, 7 Drawing Sheets

(56) References Cited

U.S. PATENT DOCUMENTS 3,811,041 A * 5/1974 Matsushita ..... F21S 10/00 362/249.13
4,179,832 A * 12/1979 Lemelson ..... F21S 2/00 345/32
4,263,743 A * 4/1981 Hanson ..... G09F 19/08 362/197
4,464,440 A * 8/1984 Dotzman ..... B44C 5/02 428/16
4,779,172 A * 10/1988 Jimenez ..... A44C 15/0015 362/104
4,992,704 A * 2/1991 Stinson ..... H05B 33/0821 313/303
5,664,879 A * 9/1997 Lai ..... F21S 6/001 362/249.01
D451,625 S 12/2001 Sehl
6,424,096 B1 * 7/2002 Lowe ..... H05B 37/0272 315/185 R
6,578,981 B2 * 6/2003 Jackson ..... A44C 15/0015 362/103
D485,633 S 1/2004 Krumholz
6,690,120 B2 * 2/2004 Oskorep ..... F21S 4/10 315/178
6,884,080 B2 * 4/2005 Thompson ..... G09B 23/36 428/16
6,896,390 B2 5/2005 Yu et al.
6,954,659 B2 * 10/2005 Tushinsky ..... G08B 1/08 340/12.54
7,036,962 B2 * 5/2006 Chan ..... A44C 15/0015 362/103
7,131,748 B2 * 11/2006 Kazar ..... H05B 37/029 315/184
7,178,930 B2 * 2/2007 Damrau ..... A44C 15/0015 362/104
7,293,896 B2 11/2007 Cheung
8,070,325 B2 12/2011 Zampini et al.
8,454,187 B2 * 6/2013 Chen ..... F21V 21/002 362/122
8,512,045 B2 * 8/2013 Bittner ..... B32B 27/302 428/34.1
2003/0086260 A1 5/2003 Terrell et al.
2006/0154224 A1 * 7/2006 St.Ama ..... G09B 23/36 434/296

* cited by examiner

LIGHTING HARNESS FOR ILLUMINATING ANIMAL SKULL

CROSS REFERENCE TO RELATED APPLICATIONS

This application claims priority under 35 U.S.C. §120 as a continuation-in-part of U.S. Nonprovisional patent application Ser. No. 13/773,698, filed Feb. 22, 2013, which application claims the benefit of U.S. Provisional Patent Application No. 61/601,914, filed Feb. 22, 2012, and U.S. Provisional Patent Application No. 61/696,371, filed Sep. 4, 2012, which applications are incorporated herein by reference in their entireties.

TECHNICAL FIELD

The invention relates to an illuminated animal skull, and, more specifically, to an illuminated animal skull comprising a lighting apparatus to illuminate cavities and translucent areas of the skull.

BACKGROUND

Three-dimensional cavernous structures can be difficult to light for ornamental purposes. Examples of three-dimensional cavernous structures can include sculptures and animal skulls, either of which may be translucent. Such structures typically need to be lit from the inside, but if the light source is too close to the material of the structure, the light may run too hot thereby damaging or deteriorating the interior of the structure. As a result, in some instances, the decision is made to not light the structure rather than risk damaging or deteriorating the structure.

Another problem with lighting three-dimensional cavernous structures is finding a light source that is capable of evenly distributing the light so that the entire structure is well-illuminated, rather than one intense light source that does not allow for adequate observation of a structure's ornate detail.

European mounts or skull mounts are used for mounting animal heads such as deer, elk, and bear heads. If the animal is antlered, the antlers are typically left intact. Animal skulls can also be mounted on such mounts. The skulls are cleaned of all flesh and soft tissue through a boiling process, and then the skull is typically bleached. There are other well-known methods for removing tissue from a skull.

Although a bleached skull is white, after mounting it may appear dark and visually difficult to distinguish the features of the skull. As a result, mounted skulls in dimly lit areas may not appear very attractive. Presently, there are no effective ways to improve the appearance of a mounted skull.

Thus, there exists a long felt need for a lighting apparatus which is capable of lighting the interior of a three-dimensional cavernous structure without damaging or deteriorating the interior, providing adequate light distribution, and also improving the appearance of a mounted skull to make it more aesthetically appealing and impressive.

SUMMARY OF THE INVENTION

The present invention broadly comprises an illuminated assembly, comprising a skull of an animal having a nasal cavity, a brain cavity, and a pair of eye sockets, and a lighting harness comprising at least four lighting elements, wherein at least one lighting element is operatively arranged within the nasal cavity, at least one lighting element is operatively arranged within the brain cavity, and at least one lighting element is operatively arranged within each of the eye sockets.

The present invention also comprises an illuminated skull of an animal, comprising a plurality of cavities and, a lighting harness, comprising at least one lighting element, operatively arranged to emit light through the plurality of cavities.

The present invention further comprises a lighting harness, comprising a first lighting element, a second lighting element, a third lighting element, a fourth lighting element, a first wire having a first length, wherein the first lighting element is operatively arranged on the first wire, a second wire having a second length, wherein the second lighting element is operatively arranged on the second wire, a third wire having a third length, wherein the third lighting element is operatively arranged on the third wire and, a fourth wire having a fourth length, wherein the fourth lighting element is operatively arranged on the fourth wire, wherein the second length is shorter than the first length, the third length is shorter than the first length but is of substantially similar length as the second length and, the fourth length is shorter than the first, second, and third lengths.

Although the lighting apparatus disclosed herein is described in connection with a skull and a skull mount, it will be appreciated that the lighting apparatus may also be used with any other suitable three-dimensional cavernous structure.

European mounting is a method commonly employed to mount a skull such that it can be displayed, for example, on a wall. Recent advances in light emitting diode (hereinafter referred to as LED) technology make it possible to produce significant light intensity with minimal heat. Thus, LED lights can be mounted in close proximity to valuable objects without the risk of burning or damaging or deteriorating the objects.

The present lighting apparatus and mount includes a wiring harness, a switch, and an AC adapter in one of the preferred embodiments. The lighting harness installs internal to the skull and the wiring harness includes a plurality of LEDs.

When power is supplied to the LEDs they emit light that illuminates the bones of the skull, as well as emit light through the eye and nose openings defined in the skull. Depending on the transparency of the skull, the emitted light may be seen through the bone. The LEDs are embodied to have virtually any desired color or be a multicolor RGB (Red, Green, Blue) LED.

The skull can be mounted on a European style mount or other suitable mount, and the switch allows the user to select 120V or 240V.

In other preferred embodiments there are light sensors, motion sensors, and audio chips that are incorporated into the lighting apparatus.

In other preferred embodiments the wiring harness is powered by a direct current via a DC battery, and may be powered by solar power.

A general object of the invention is to provide a lighting harness with light emitting diodes which is operatively arranged within the skull of an animal to illuminate translucent areas of the skull.

A further object of the invention is to provide an illuminated animal skull which can vary the color of the light emitting diodes.

An even further object of the invention is to provide a lighting apparatus capable of lighting the interior of a three-dimensional cavernous structure without damaging or deteriorating the interior, while providing adequate light distribution.

An even further object of the invention is to improve the appearance of a mounted skull to make it more aesthetically appealing and impressive.

An even further object of the invention is to provide a remote control and receiver connected to the lighting harness to control and change the color of the light emitting diodes.

An even further object of the invention is to provide a lighting apparatus which can illuminate in a plurality of modes, such as a demo mode, where the lighting apparatus illuminates in a predetermined order and timing sequence.

These and other objects, features and advantages of the present invention will become readily apparent upon a reading and review of the following detailed description of the invention, in view of the appended drawings and claims.

DETAILED DESCRIPTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this patent is not limited to the particular methodology, materials and modifications described and, as such, may, of course, vary. It is also understood that the terminology used herein is for the purpose of describing particular aspects only, and is not intended to limit the scope of the present invention as claimed.

Unless defined otherwise, all technical and scientific terms used herein have the same meaning as commonly understood to one of ordinary skill in the art to which this invention pertains. It should be understood that any methods, devices or materials similar or equivalent to those described herein can be used in the practice or testing of the invention.

Figure 1:
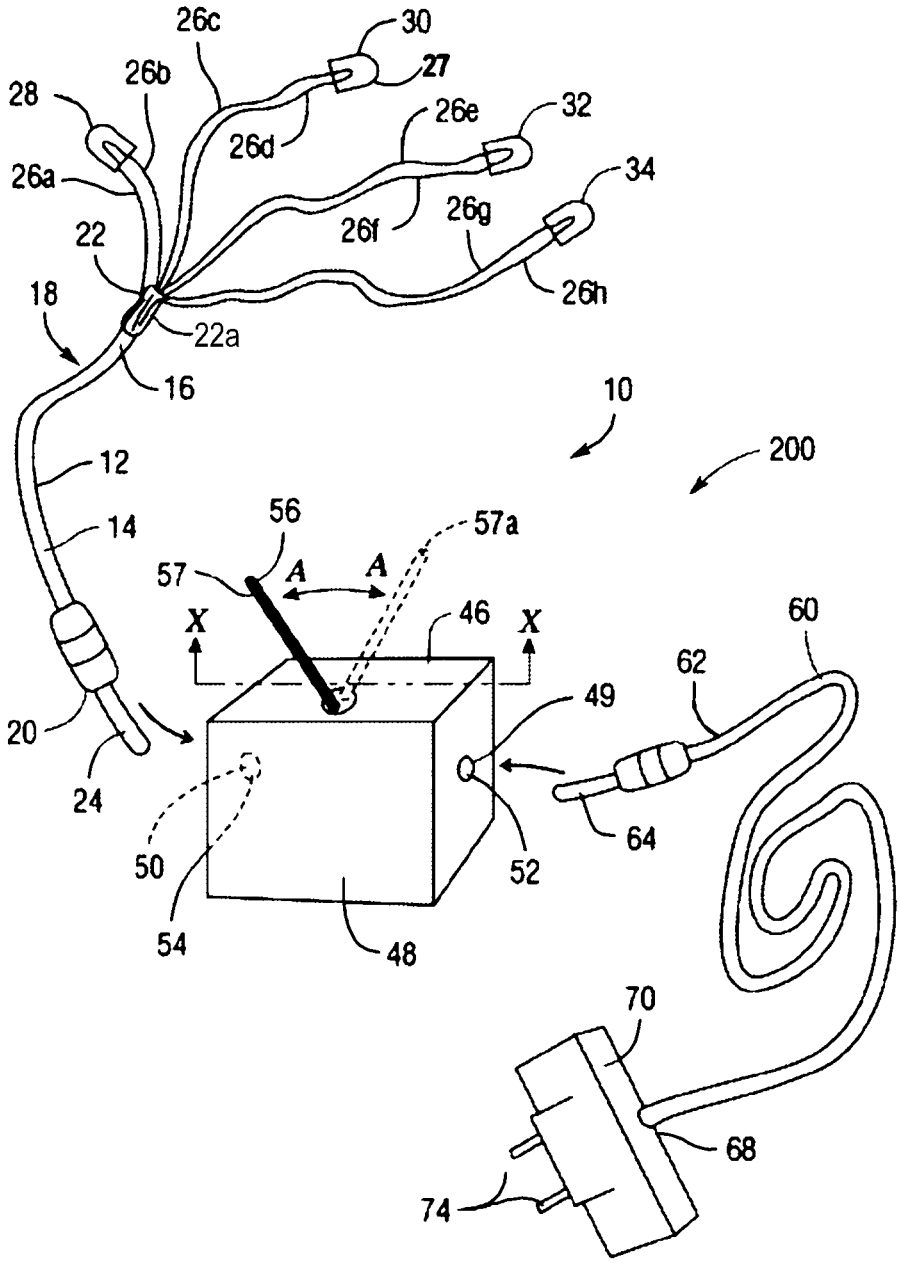
FIG. 1 is a diagrammatic view of the components of a lighting apparatus.

Adverting now to FIG. 1, shown therein are the components of the lighting apparatus 10. Lighting apparatus 10 includes lighting harness 12 that includes harness power cord 14. Harness power cord 14 has outer casing 16 that provides for insulation, and disposed internal to outer casing 16 are a plurality of electrical leads 18. In one of the preferred embodiments, electrical leads 18 are in the form of electric leads 26*a*, 26*b*, 26*c*, 26*d*, 26*e*, 26*f*, 26*g*, and 26*h*. Harness power cord 14 also has opposed first and second harness power cord ends 20 and 22. First power cord end 20 has attached to it electric socket 24. Second end 22 of harness power cord 14 joins to wire guide component 22*a*. As shown, electric leads 26*a*, 26*b*, 26*c*, 26*d*, 26*e*, 26*f*, 26*g*, and 26*h* extend through wire guide component 22*a* such that they are disposed outside outer casing 16 and exposed in that they are no longer disposed internal to outer casing 16. Electric leads 26*a*, 26*b*, 26*c*, 26*d*, 26*e*, 26*f*, 26*g*, and 26*h* that extend beyond wire guide component 22*a* are capable of branching out from one another.

Lighting harness 12 also includes light source 27. In one of the preferred embodiments, light source 27 is in the form of a LED. Attached to the first pair of electric leads 26*a*, 26*b* is LED 28, attached to the second pair of electric leads 26*c*, 26*d* is LED 30, attached to the third pair of electric leads 26*e*, 26*f* is LED 32, and attached to the fourth pair of electric leads 26*g*, 26*h* is LED 34. It is to be understood that in other preferred embodiments there may be more or less than four pairs of electric leads and more or less than four LEDs. The use and operation of an LED is well known to those having ordinary skill in the art and is therefore not described in greater detail herein.

LEDs 28, 30, 32, 34 are able to emit any desired color of light. Thus, the coloring of the LEDs is not limited to white light or any particular color. In a preferred embodiment, LEDs 28, 30, 32, 34 are multicolor RGB (Red, Green, Blue) LEDs. It is pointed out that electric socket 24 is for delivering electrical power to electric leads 26*a*, 26*b*, 26*c*, 26*d*, 26*e*, 26*f*, 26*g*, and 26*h*.

Figure 2:
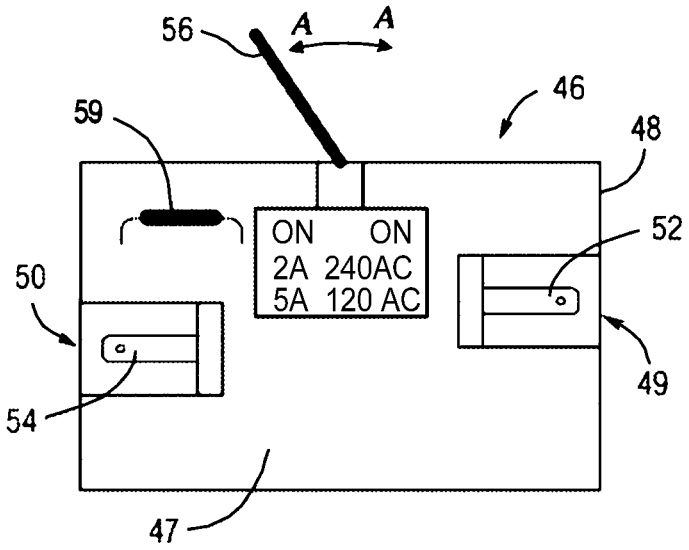
FIG. 2 is a sectional view of a switch for use in the lighting apparatus taken along line X-X of FIG. 1.
Figure 3:
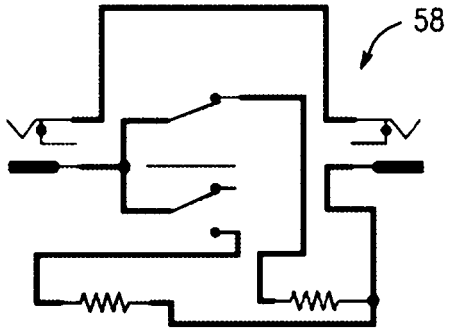
FIG. 3 is a view of a circuit for use in the switch.

As shown in FIG. 2 and FIG. 3, lighting apparatus 10 further includes switch assembly 46. Switch assembly 46 includes housing 48, which defines inlet and outlet openings 49, 50. Aligned with inlet opening 49 and disposed internal to housing 48 is first plug 52, and aligned with outlet opening 50 and disposed internal to housing 48 is second plug 54. Switch assembly 46 also includes switch 56 that is movable from a first switch position 57 (for 2 amps, 240 volts) to a second switch position 57*a* (for 5 amp, 120 volts) shown in dashed lines, and as indicated by the arrow designated A-A in FIG. 1 and FIG. 2. Switch assembly 46 also includes board 47 and resistor 59. Switch 56 is soldered to board 47, first and second plugs 52, 54 are soldered to board 47, and resistor 59 is soldered to board 47. FIG. 3 is a diagram of circuit board 58 for use in switch assembly 46. Construction, use and operation of circuit boards is well known to those having ordinary skill in the art and is therefore not described in greater detail herein.

Electric socket 24 is capable of being fitted on second plug 54 such that electrical power can be delivered to LEDs 28, 30, 32, 34. As shown in FIG. 1, lighting apparatus 10 also includes power source cord 60 having first power cord source end 62, and second electric socket 64 attached to first power cord source end 62. Second electric socket 64 is capable of being fitted on first plug 52 disposed in housing 48 such that electrical power can be delivered to switch assembly 46. There is also second power cord source end 68 that is connected to transformer 70, which has prongs 74 adapted to be inserted into, for example, standard wall receptacle 75 (see FIG. 4). Standard wall receptacle 75 provides external power source 77 in the form of alternating current for powering lighting apparatus 10. Transformers are well known to those having ordinary skill in the art and are not described in greater detail herein.

When electrical power is delivered to LEDs 28, 30, 32, 34 causing them to emit light 100 (see FIG. 4), transformer 70 is plugged into wall receptacle 75, second electric socket 64 is moved onto first plug 52, switch 56 is moved to the appropriate position, and electric socket 24 is moved onto second plug 54.

Figure 4:
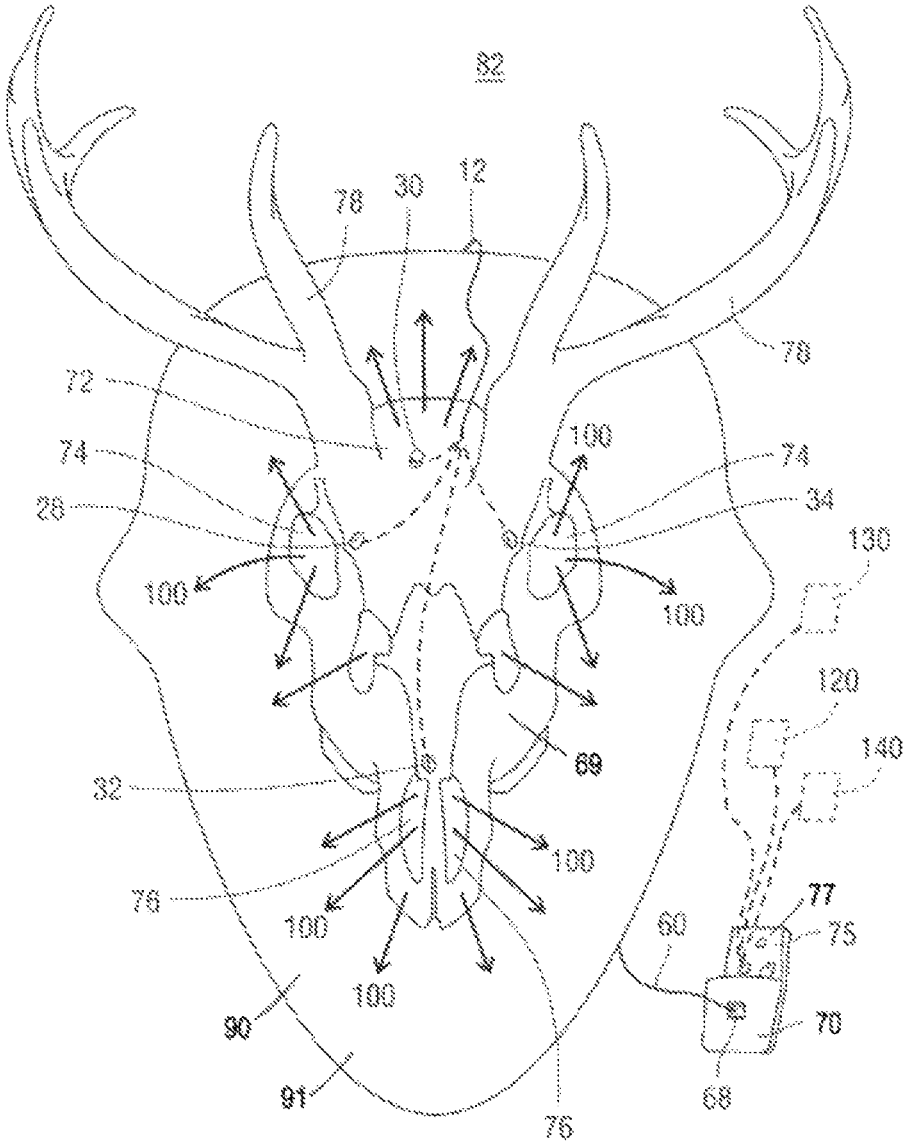
FIG. 4 is a front view of a deer skull wherein the lighting apparatus is installed in a deer skull.

As shown in FIG. 4, housing 69 is in the form of skull 72, and more specifically, in the form of a deer skull. It should be appreciated that the skull can be a real, synthetic, or an artificial skull. Skull 72 defines eye socket openings 74, nostril openings 76, and antlers 78 that extend from skull 72.

Figure 5:
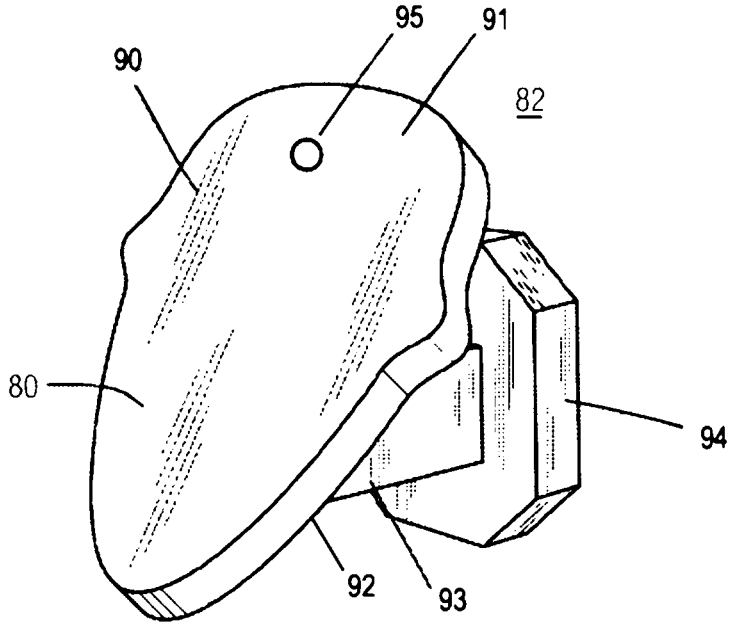
FIG. 5 is a perspective view of a European mount attached to a wall for use in connection with the deer skull shown in FIG. 4.
Figure 6:
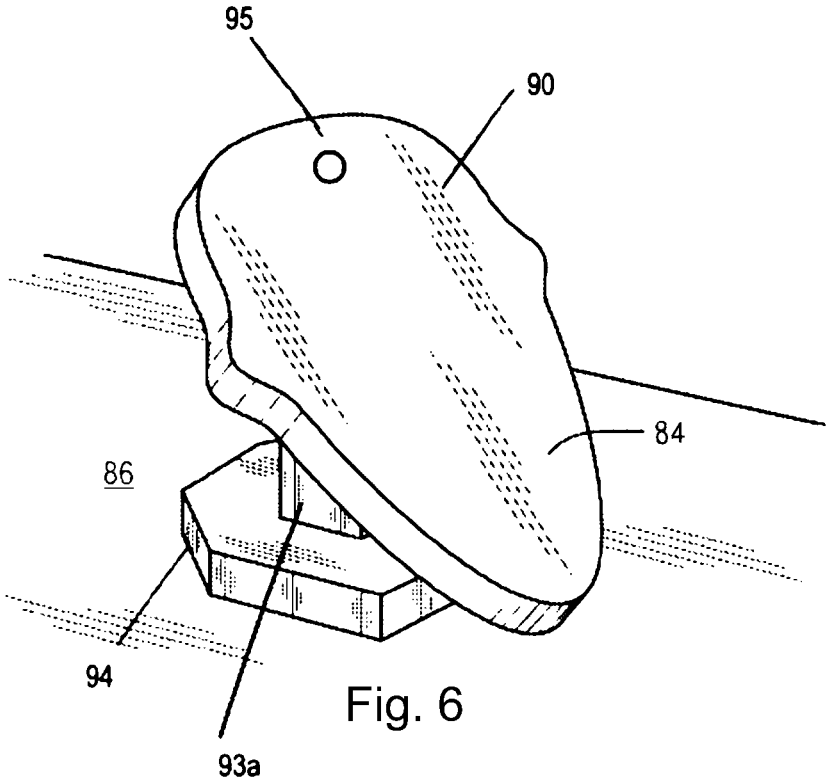
FIG. 6 is a perspective view of a mount supported on a flat surface for use in connection with the deer skull shown in FIG. 4.

As shown in FIG. 5, skull 72 is supported on a wall mount (embodied herein as a European style head mount) that is secured to wall 82. In another preferred embodiment, shown in FIG. 6, table mount 84 supports skull 72. Wall mount 80 includes plaque 90 to which skull 72 secures, for example with glue or fasteners. Plaque 90 has opposed first and second sides 91, 92 and skull 72 secures to first side 91 (as shown in FIG. 4). Second side 92 secures to connecting member 93, and connecting member 93 secures to base member 94. Connecting member 93 is substantially perpendicular to base member 94, and at an angle relative to plaque 90.

Table mount 84 also has plaque 90 and base member 94 as described above. Plaque 90 secures to connecting member 93*a*, and connecting member 93*a* secures to base member 94. Shelf 86 supports base member 94. In one of the preferred embodiments, plaque 90 defines plaque opening 95. Harness power cord 14 can be fitted through plaque opening 95.

To illuminate skull 72, lighting harness 12 is fitted and arranged in skull 72, and first, second, third, and fourth LEDs 28, 30, 32, 34 are provided with power such that light 100 (depicted as arrows in FIG. 4) emits from first, second, third, and fourth LEDs 28, 30, 32, 34. Shown in FIG. 4, harness power cord 12 extends over plaque 90 to switch assembly 48 (not shown in FIG. 4) and then to transformer 70 that is plugged into wall receptacle 75 in order to provide power to LEDs 28, 30, 32, 34. Some of the light exits though eye socket openings 74 and nostril openings 76, and some of light 100 is transmitted through skull 72 to cause skull 72 to glow in the color of light 100. Skull 72 can be made of real bone or synthetic bone and may be embodied as virtually any desired animal skull including mammal, reptile, and aquatic creature skulls. In other preferred embodiments, lighting apparatus 10 is placed within a three-dimensional cavernous sculpture or some similar structure rather than a skull.

In another preferred embodiment, switch assembly 46 is not utilized and lighting harness 12 is powered by a direct DC battery hookup. The present invention can have a plurality of possible configurations including but not limited to any number of lights. With respect to the type of light used, typically LEDs are used as they generate very little heat and good light intensity, but other types of lights may be used as well, and other power sources may be used.

The power source is flexible and may include but is not limited to using batteries (DC), direct wiring (AC), and solar panel designs. Quick connections and on/off switches may be integrated into the design.

LEDs 28, 30, 32, 34 are controlled with a manual on-off switch that is part of lighting apparatus 10. For example, receptacle 75 may be under the control of a wall-mounted switch to power apparatus 10 or power off lighting apparatus 10. In addition, as shown in FIG. 4, in other preferred embodiments lighting apparatus 10 can be under the control of motion sensor 120, light sensor 130, and/or audio chip 140 (all shown in dashed lines in FIG. 4) that are in controlling communication with the power source. Motion sensor 120 is preferably on all of the time but may be overridden so that light does not come on when motion is detected. Likewise, light sensor 130 is preferably on all of the time but can be overridden so that the light does not come on when light is detected. Audio chip 140 can make a sound and can record an event or audio recording to be played back at a desired time. All of these components may be mounted inside skull 72, in or on mount 80, table mount 84, or on wall 82.

Lighting apparatus 10 can be sold as kit 200 that includes the components shown in FIG. 1, that is, lighting harness 12, switch assembly 46, and transformer 70. For example, a taxidermist may buy just lighting apparatus 10 and use his or her own skulls 72. Indeed, lighting apparatus 10 has many applications for the lights in the field of taxidermy. Lighting apparatus 10 can be installed in full body mounts of animals to light and illuminate virtually any area of the body of the animal in addition to skull 72. Lighting apparatus 10 can also be used in connection with stuffed animals (not shown). Lighting apparatus 10 may also be used external to skull 72 such that full mounts can be illuminated from beneath, above, or from the sides. The availability of lights, for example the LEDs described herein, that produce little to no heat makes lighting taxidermy from the inside and out more feasible.

Figure 7:
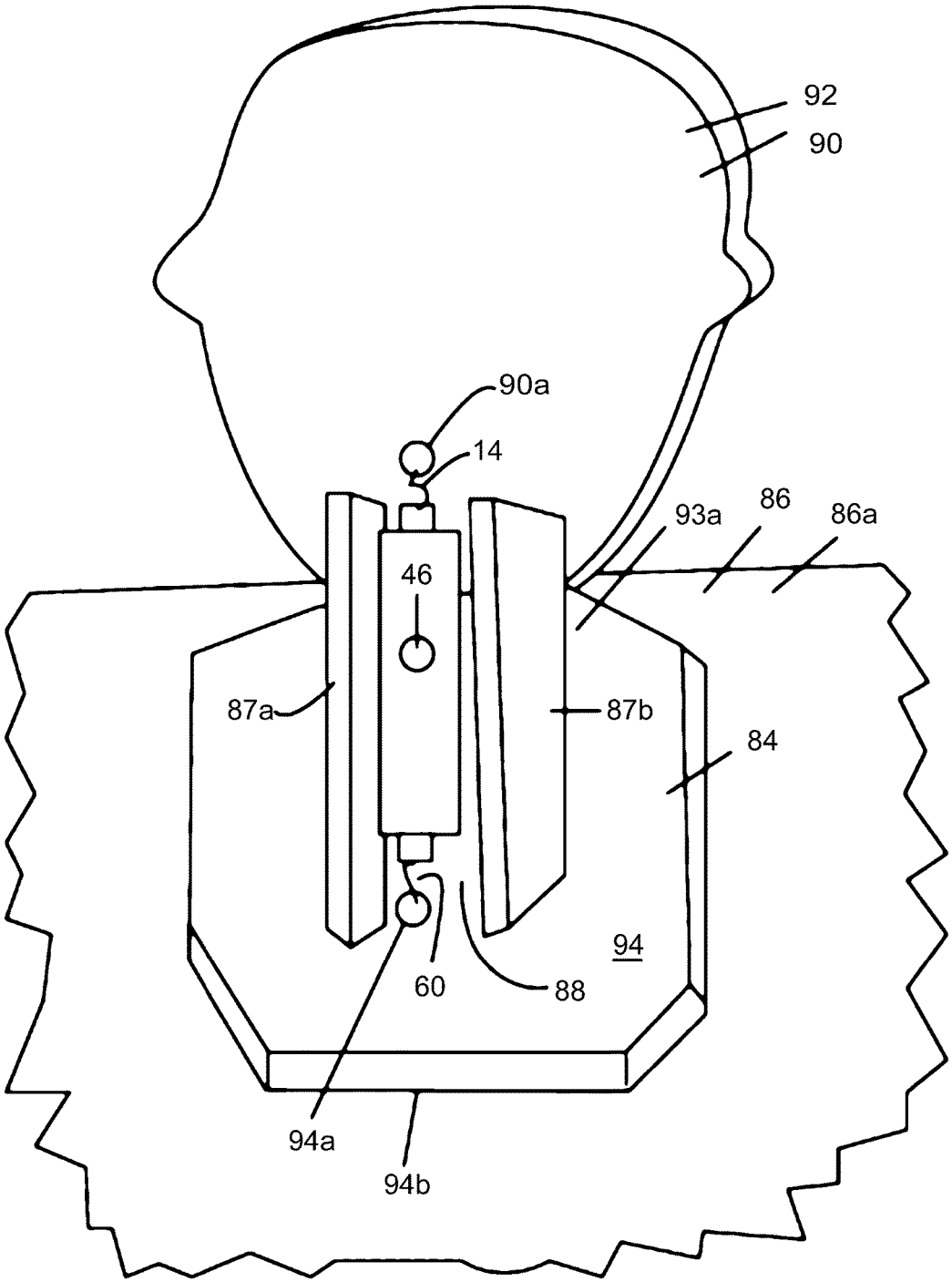
FIG. 7 is a rear view of a table mount supported on a flat surface.

As shown in rear view of FIG. 7, table mount 84 is supported on flat surface 86*a* of shelf 86. In this embodiment, storage compartment connecting member 93*a* has a pair of spaced apart connecting members 87*a*, 87*b* that interconnect base member 94 and plaque 90. Compartment space 88 is defined between first and second connecting members 87*a*, 87*b*, and plaque 90. Compartment space 88 receives switch assembly 46 therein. Base member 94 defines base member opening 94*a* disposed between first and second connecting members 87*a*, 87*b*, through which power source cord 60 extends. Plaque 90 defines plaque opening 90*a* proximal first and second connecting members 87*a*, 87*b* through which harness power cord 14 extends. Base member 94 also defines groove 94*b* on the side opposite from which first and second connecting supports 87*a*, 87*b* extend, and groove 94*b* is sized to accommodate power source cord 60 therein. As shown, switch assembly 46, power source cord 60, and harness power cord 14 are disposed a way such that table mount 84 is aesthetically pleasing.

Figure 8:
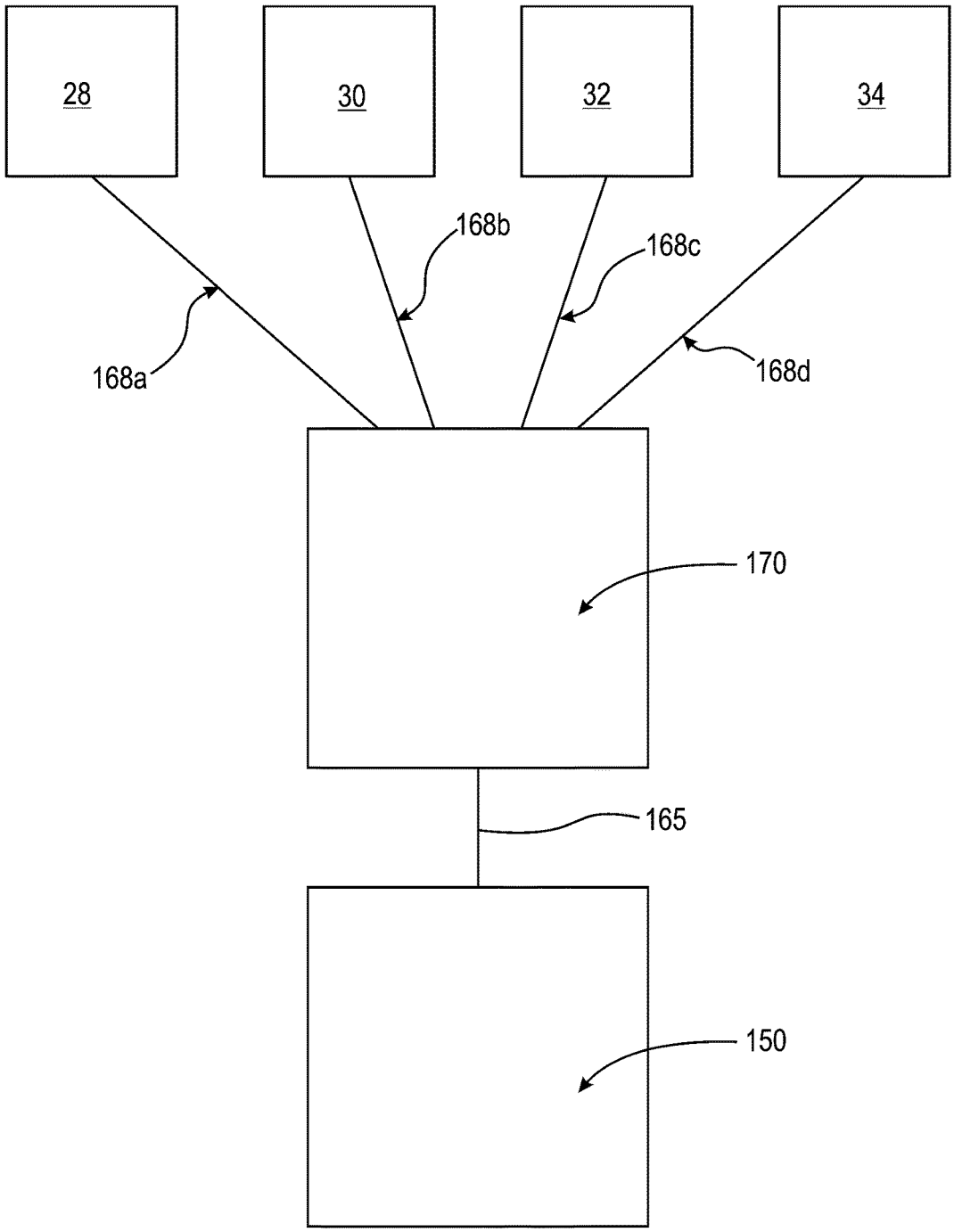
FIG. 8 is a perspective view of remote control 150.

In another embodiment, lighting apparatus 10 comprises remote control 150 and receiver 170 which connect to lighting apparatus 10 in order to vary the color of LEDs 28, 30, 32, 34. LEDs 28, 30, 32, 34 are multicolor RGB (Red, Green, Blue) LEDs, which can vary in color depending on the signal that is received. As shown in FIG. 8, remote control 150 sends signal 165 to receiver 170. In a preferred embodiment, remote control 150 transmits signal 165 to receiver 170 via radio frequency signals. It should be appreciated, however, that the use of different types of wireless communication is possible and considered to be within the scope of the invention as claimed. For example, remote control 150 and receiver 170 could communicate through infrared signals. Signals 168*a*, 168*b*, 168*c*, and 168*d* are representative of the color changes of LEDs 28, 30, 32, and 34. Remote control 150 sends signal 165 to receiver 170 to initiate signals 168*a*, 168*b*, 168*c*, and 168*d*, which are sent to LEDs 28, 30, 32, and 34 in order to change the color of each LED. Signals 168*a*, 168*b*, 168*c*, and 168*d* are sent from receiver 170 in a predetermined order and timing sequence.

In a preferred embodiment, LEDs 28, 30, 32, and 34 illuminate identical colors when a signal is received and each LED changes color in the same predetermined order during the same timing sequence. It should be appreciated, however, that the use of different combinations of color and timing sequences is possible and considered to be within the scope of the invention as claimed.

Figure 9:
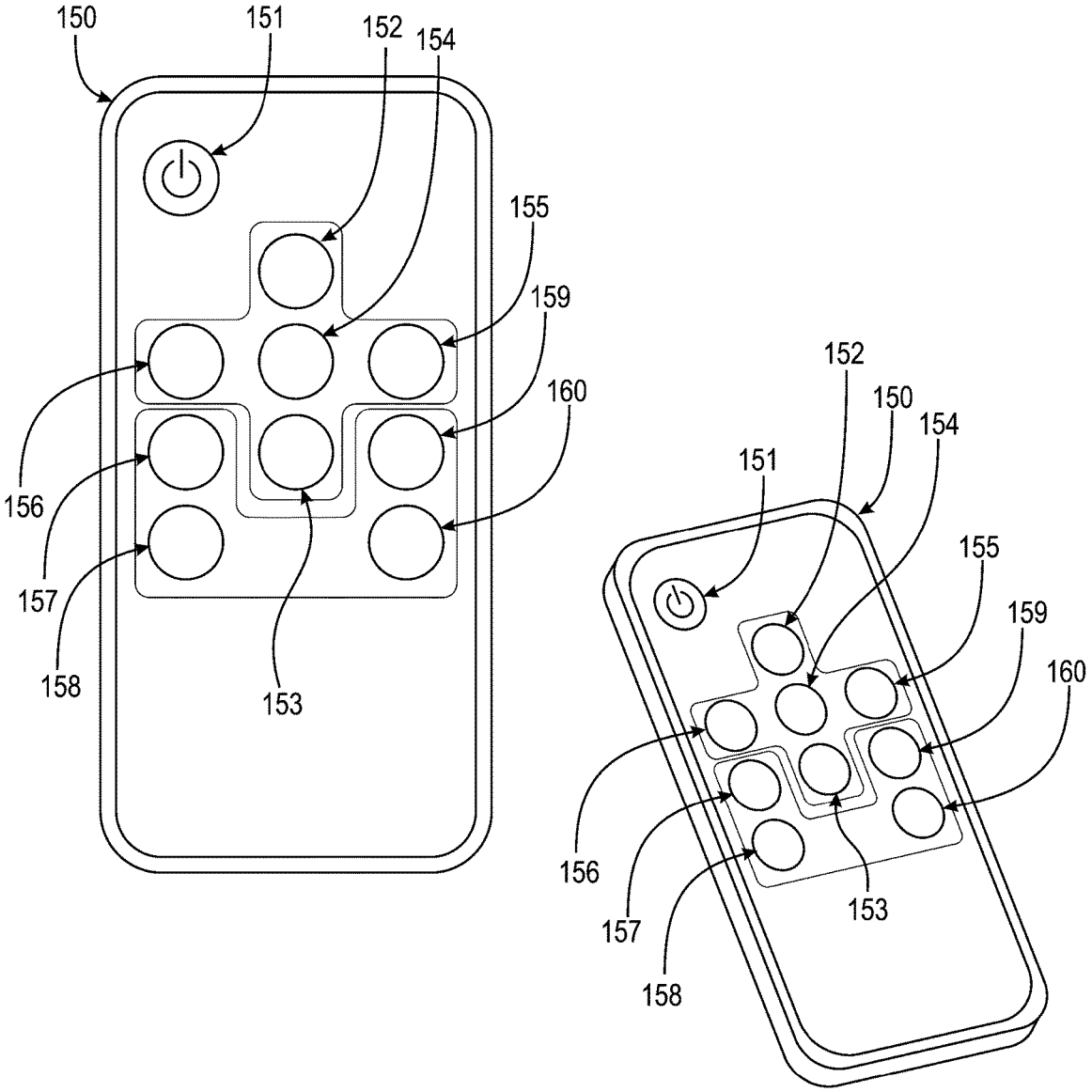
FIG. 9 is a block diagram illustrating a remote control and receiver communication system of the present invention.

As shown in FIG. 9, remote control 150 comprises power button 151, mode+ button 152, mode− button 153, demo button 154, speed+ button 155, speed− button 156, color+ button 157, color− button 158, bright+ button 159, and bright− button 160. Every time a button is engaged on remote control 150, remote control 150 sends signal 165 (shown in FIG. 8) to receiver 170. When power button 151 is engaged, receiver 170 turns on or off lighting apparatus 10, depending on which state lighting apparatus 10 is currently in. When either mode+ button 152 or mode− button 153 is engaged, receiver 170 changes the predetermined order and timing sequence of LEDs 28, 30, 32, and 34. In a first mode, LEDs 28, 30, 32, and 34 each illuminate the same color in a pulsing pattern. In a second mode, LEDs 28, 30, 32, and 34 illuminate a single color and then immediately change to another color, rotating through each color in a predetermined order. In a third mode, LEDs 28, 30, 32, and 34 illuminate a single color, then immediately turn off, and then illuminate again with a different color than the previous color in a predetermined order. In a fourth mode, LEDs 28, 30, 32, and 34 illuminate the same color and turn on and off in quick succession, similar to a strobe light. In a fifth mode, LEDs 28, 30, 32, and 34 illuminate a single color, then slowly turn off, and then illuminate again with a different color than the previous color in a predetermined order. In a sixth mode, LEDs 28, 30, 32, and 34 illuminate a single color and do not change unless receiver 170 receives signal 165 from remote control 150.

When demo button 154 is engaged, receiver 170 places lighting apparatus 10 into the fifth mode described previously. When speed+ button 155 or speed− button 156 is engaged, the rate at which LEDs 28, 30, 32, and 34 illuminate increases or decreases, respectively, when lighting apparatus 10 is in the first mode, second mode, third mode, or fifth mode. When color+ button 157 or color− button 158 is engaged, remote control 150 sends signal 165 to receiver 170 in order to change the color of LEDs 28, 30, 32, and 34 according to a predetermined order when lighting apparatus 10 is in the sixth mode. When bright+ button 159 or bright− button 160 is engaged, the intensity at which LEDs 28, 30, 32, and 34 illuminate is increased with bright+ button 159 or decreased with bright− button 160. In a preferred embodiment, remote control 150 and receiver 170 are an Easy-Plug Multi-Color LED Controller with RF Remote Control, available for purchase from HIT International LLC, located at Suite 111, Building 3100, 8000 GSRI Avenue, Baton Rouge, La. 70820.

It will be appreciated that various features of the above-described invention and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An illuminated skull of an animal, comprising:

a plurality of cavities; and, a lighting harness, comprising at least one lighting element operatively arranged in said skull to emit light through said plurality of cavities, wherein said skull is translucent.

2. The illuminated skull of an animal recited in claim 1, wherein said lighting harness receives electrical power from a battery.

3. The illuminated skull of an animal recited in claim 1, wherein said lighting harness receives electrical power from an AC adapter.

4. The illuminated skull of an animal recited in claim 1, wherein said plurality of cavities comprises at least one nasal cavity, a brain cavity, and a pair of eye sockets.

5. The illuminated skull of an animal recited in claim 1, wherein said at least one lighting element comprises one or more light emitting diodes.

6. The illuminated skull of an animal recited in claim 5, wherein said light emitting diodes are multicolor RGB (Red, Green, Blue) light emitting diodes.

7. The illuminated skull of an animal recited in claim 1, further comprising a remote control and a receiver, wherein said receiver connects to said lighting harness and receives a signal from said remote control.

8. The lighting assembly recited in claim 7, wherein said remote control and said receiver use radio frequency signals.

9. The lighting assembly recited in claim 7, wherein said remote control and said receiver use infrared signals.

10. The lighting assembly recited in claim 7, wherein said lighting element is a multicolor lighting element, and said remote control and said receiver are configured to control the color of said lighting element.

11. The lighting assembly recited in claim 10, wherein said remote control and said receiver can place said light harness in a demo mode, wherein said lighting element will vary in color in a predetermined sequence.

12. An illuminated assembly, comprising:

a skull of an animal having a nasal cavity, a brain cavity, and a pair of eye sockets, wherein said skull is translucent; and, a lighting harness, comprising at least three lighting element, wherein at least one lighting element is operatively arranged within said nasal cavity, at least one lighting element is operatively arranged within said brain cavity, and at least one lighting element is operatively arranged within said skull such that light is emitted from each of said eye sockets.

13. The lighting assembly recited in claim 12, wherein said lighting harness receives electrical power from an AC adapter.

14. The lighting assembly recited in claim 12, wherein said lighting harness receives electrical power from a battery.

15. The illuminated assembly recited in claim 12, wherein each of said lighting elements comprise one or more light emitting diodes.

16. The illuminated assembly recited in claim 15, wherein said light emitting diodes are multicolor RGB (Red, Green, Blue) light emitting diodes.

17. The lighting assembly recited in claim 12, further comprising a remote control and a receiver, wherein said receiver connects to said lighting harness and receives a signal from said remote control.

18. The lighting assembly recited in claim 17, wherein said remote control and said receiver use radio frequency signals.

19. The lighting assembly recited in claim 17, wherein said remote control and said receiver use infrared signals.

20. The lighting assembly recited in claim 17, wherein said lighting elements are multicolor lighting elements, and said remote control and said receiver are configured to control the color of said lighting elements.

21. The lighting assembly recited in claim 20, wherein said remote control and said receiver can place said light harness in a demo mode, wherein said lighting elements will vary in color in a predetermined sequence.

22. A lighting assembly, comprising:

an animal skull, including:

a first and second eye socket;

a brain cavity; and, a first and second nasal cavity;

a lighting harness, comprising:

a first lighting element operatively arranged on a first wire within said first nasal cavity, said first wire having a first length;

a second lighting element operatively arranged on a second wire within said second nasal cavity, said second wire having a second length; and, a third lighting element operatively arranged on a third wire within said brain cavity, said third wire having a third length;

wherein the arrangement of said lighting elements within said animal skull allow light to be emitted through said cavities and said eye sockets;

a remote control and a receiver, wherein said receiver connects to said lighting harness and receives a signal from said remote control; and, a mount, comprising:

a base member;

a plaque having a first surface and a second surface; and, a connecting member having a proximal end secured to said base member and a distal end secured to said second surface, wherein said animal skull is secured to said first surface;

wherein said plaque comprises a first through-bore, said base member comprises a second through-bore, and said connecting member comprises a storage compartment.

23. The lighting assembly recited in claim 22, wherein said remote control and said receiver use radio frequency signals.

24. The lighting assembly recited in claim 22, wherein said remote control and said receiver use infrared signals.

25. The lighting assembly recited in claim 22, wherein said receiver is operatively arranged in said storage compartment and further comprises:

a power source cord extending through said second through-bore, said power source cord having:

a first end electrically connected to a power source; and, a second end electrically connected to said receiver; and, a lighting harness power cord extending through said first through-bore, said lighting harness power cord having:

a third end electrically connected to said receiver; and, a fourth end electrically connected to said lighting harness.

26. The lighting assembly recited in claim 22, wherein said receiver and a battery are operatively arranged in said storage compartment and further comprises:

a power source cord arranged in said storage compartment, said power source cord having:

a first end electrically connected to said battery; and, a second end electrically connected to said receiver; and, a lighting harness power cord extending through said first through-bore, said lighting harness power cord having:

a third end electrically connected to said receiver; and, a fourth end electrically connected to said lighting harness.

27. The lighting assembly recited in claim 22, wherein said each of said lighting elements comprise one or more light emitting diodes.

28. The lighting assembly recited in claim 27, wherein said light emitting diodes are multicolor RGB (Red, Green, Blue) light emitting diodes.

29. The lighting assembly recited in claim 22, wherein said lighting elements are multicolor lighting elements, and said remote control and said receiver are configured to control the color of said lighting elements.

30. The lighting assembly recited in claim 29, wherein said remote control and said receiver can place said lighting harness in a demo mode, wherein said lighting elements will vary in color in a predetermined sequence.

* * * * *